United States Patent [19]

Campbell, Jr. et al.

[11] Patent Number: 4,512,274

[45] Date of Patent: Apr. 23, 1985

[54] SEAM FOR TUBE OF CLOTH, FABRIC OR FLEXIBLE MATERIAL

[76] Inventors: Richard J. Campbell, Jr., 1006 Orange Grove Ave., Glendale, Calif. 91205; Kirk B. Campbell, 1531 Broadview, Glendale, Calif. 91208

[21] Appl. No.: 413,794

[22] Filed: Sep. 1, 1982

[51] Int. Cl.[3] ..... D05B 1/10; D05B 1/18

[52] U.S. Cl. ..... 112/423; 112/426; 112/438

[58] Field of Search ..... 112/423, 426, 438, 440, 112/441

[56] References Cited

U.S. PATENT DOCUMENTS

| | | | |
|---|---|---|---|
| 894,567 | 7/1908 | Arbetter | 112/441 |
| 1,081,197 | 12/1913 | Barnett | 112/441 |
| 1,822,799 | 9/1931 | Christensen | 112/426 |
| 2,079,569 | 5/1937 | Christensen | 112/426 X |

OTHER PUBLICATIONS

Federal Standard No. 751a, Jan. 25, 1965, Stitch Type 406, 519; Seam Type LSb-2.

*Primary Examiner*—Wm. Carter Reynolds

*Attorney, Agent, or Firm*—Charles E. Brown; Charles A. Brown

[57] ABSTRACT

This relates to a seam between two edge portions of fabric wherein one fabric edge portion is reversely folded beneath itself and the two edge portions are then disposed in overlapped relation with the two free edges of the fabric being generally aligned. Adjacent the folded edge there is a first line of stitching which extends through all three layers. There is also provided a second line of stitching which includes two needle threads and a single looper thread with one of the needle threads extending through all three thicknesses of the fabric and the second needle thread extending only through the one layer of fabric beyond the overlapped fabric portions. The second line of stitching includes a looper thread which not only extends between the loops of the two needle threads, but also transversely of the line of stitching between the adjacent needle thread loops wherein the looper thread serves to hold down and prevent unraveling of the free edges of the fabric. The two lines of stitching may be, particularly in the case of a tubular article being sewn, sewn on a modified feed-off-the-arm machine.

8 Claims, 3 Drawing Figures

SEAM FOR TUBE OF CLOTH, FABRIC OR FLEXIBLE MATERIAL

This invention relates in general to new and useful improvements in garment seams, and more particularly to a seam configuration for a tube. Most particularly, this invention relates to a stitch configuration for a seam in a tube.

At the present it is conventional to utilize a felled seam in the formation of a cloth tube. Such a seam results in four layers of material in the resultant seam with the result that where two such seams cross, for example in a crotch seam on jeans, there are sixteen layers of material.

Another prior art seam entails making the side seam and/or inseam (closing seams) on a sew-overlock machine which leaves a flap of material standing inside the garment and no stitch showing on the outside of the garment. This seam is a relatively rough seam and is undesirable. In some instances, in order to eliminate this undesirable flap of material a second sewing operation is performed to sew this flap of material flat against the body fabric.

In accordance with this invention, it is proposed to utilize a sewing machine of the feed-off-the arm type such as Union Special Class 35800 machine modified to produce the stitch and seam construction required. Such a machine provides for three needle threads and is generally utilized in forming the aforementioned felled seam. However, in accordance with this invention, the outer layer of the fabric is reversely folded inwardly on itself with the free edge of the folded layer then being aligned with the free edge of the underlying layer. This provides for a three layer seam.

With the fabric so folded and aligned, the three layers are sewn together adjacent the fold and parallel to the fold by a first stitching. The three layers are also sewn together adjacent the free edges of the fabric by a stitching which is parallel to the first stitching. This second stitching, however, also incorporates a third needle thread which extends through only the outer layer of the fabric parallel to the second stitching and adjacent to, but spaced from the aligned free edges. The second and third needle threads are joined together by a looper thread which not only joins together adjacent loops of the second and third needle threads, but also crisscrosses between the second and third needle thread loops so as to hold down the fabric free edges so as to prevent unraveling.

The foregoing seam may be rapidly formed on a modified feed-off-the-arm machine with sufficient seam strength being obtained with only three layers of fabric by way of two needle threads passing through the three layers and the third needle thread being associated with the second needle thread by means of a crisscrossing, interconnecting looper thread which serves to hold the fabric free edges down and thus eliminates the need for any prior over the edge stitching or any trimming knife operation. The seam, therefore, may be utilized in conjunction with pattern cut materials resulting in substantial savings of these materials.

It will also be apparent that by staggering the ends of a transverse seam involving sewing together four pieces of fabric and utilizing this type of seam construction, particularly in crotches and the like, the resultant joint will have only a total of nine layers as opposed to the customary sixteen layers.

With the above and other objects in view that will hereinafter appear, the nature of the invention will be more clearly understood by reference to the following detailed description, the appended claims, and the several views illustrated in the accompanying drawing.

Figure 1:
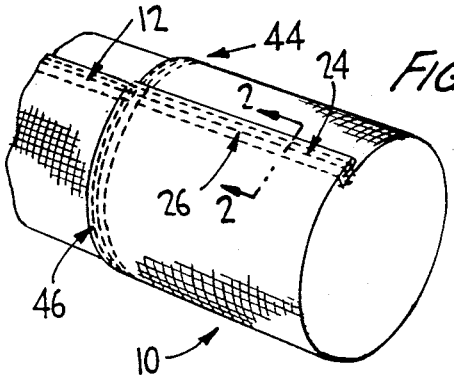
FIG. 1 is a fragmentary perspective view of a fabric tube incorporating the seam of this invention.
Figure 2:
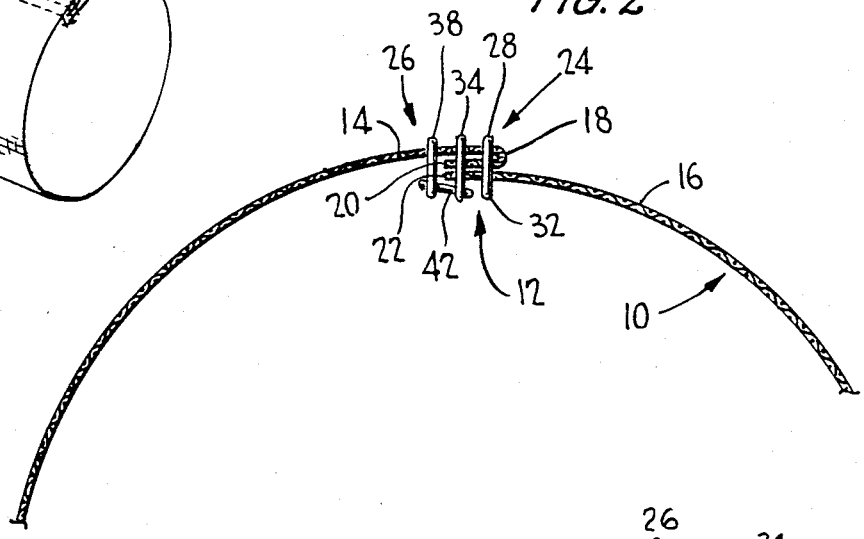
FIG. 2 is an enlarged fragmentary transverse sectional view taken generally along the line 2—2 of FIG. 1 and shows the specific seam construction including the location of the threads.

Referring now to the drawings in detail, it will be seen that there is illustrated in FIG. 1 a conventional fabric tube 10 wherein the free edges thereof are joined by way of a longitudinal seam 12. As is clearly shown in FIG. 2, the longitudinal seam 12 includes an outer fabric layer 14 and an inner fabric layer 16 with a free edge portion of the outer fabric layer 14 being reversely folded as at 18 to form a folded edge portion having a folded edge and terminating in a free edge 20. The free edge 20 of the outer fabric layer 14 is aligned with an inner edge having a free edge 22 of the inner fabric layer 16.

Figure 3:
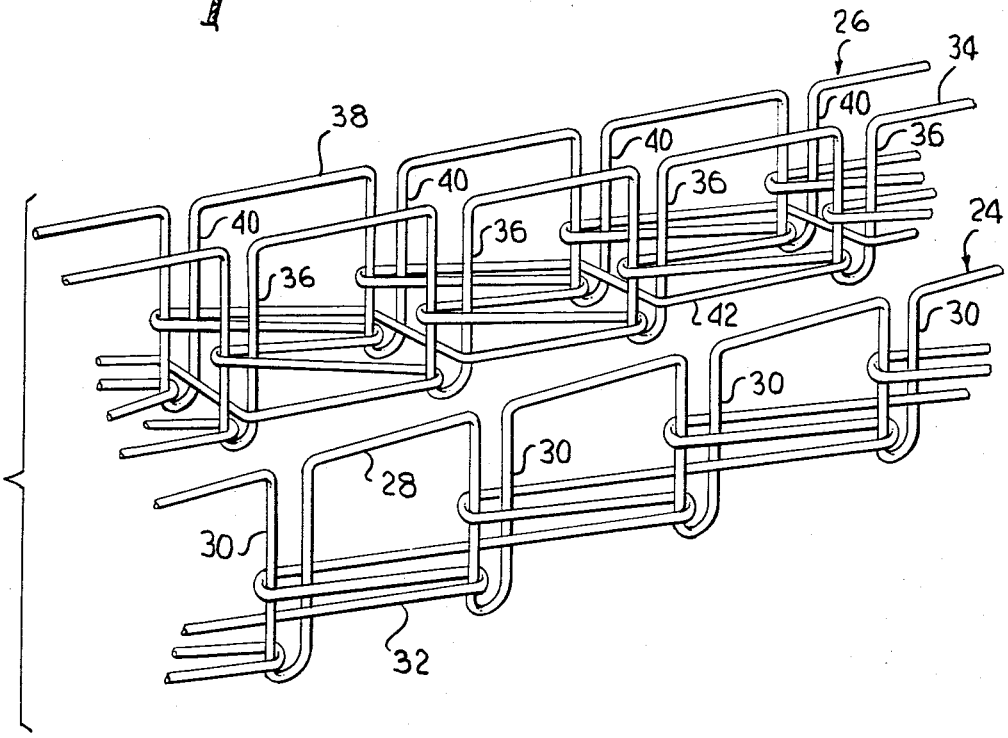
FIG. 3 is a fragmentary enlarged exploded perspective view showing the specifics of the two types of stitch formations used in forming the seam of this invention.

The seam 12 includes two stitch formations, a stitch formation 24 and a stitch formation 26. The stitch formation 24 includes a first needle thread 28 which extends through the three layers of fabric adjacent the reverse fold 18 and has loops 30 thereof joined by a first looper thread 32 as is best shown in FIG. 3. It is to be understood that the stitch formation 24 is a Federal Standard No. Stitch Type 401. The loops 30 extend entirely through the three layers of fabric being sewn and the looper thread 32 extends through a first loop, around and back through a next forward loop 30, then back around the first loop and finally forward through the next following loop. It is to be understood that the stitch 24 is a very high strength stitch formation suitable for the sewing of fabrics in the formation of jeans and like garments.

The stitch formation 26 includes a second needle thread 34 having loops 36 which extend through all three layers of fabric parallel to the stitch formation 24. The stitch formation 26 also includes a third needle thread 38 having loops 40 which extend only through the outer fabric layer 14 parallel to the loops 36 and adjacent the free edges 20, 22.

The stitch formation 26 also includes a second looper thread 42 which extends not only between each pair of adjacent loops 36 and each pair of adjacent loops 40, but in a transverse crisscross manner between transversely adjacent ones of the loops 36 and 40. The transversely extending portions of the looper thread 42 bridge across the fabric free edges 20, 22 and serve to hold the same down and to prevent unraveling of the fabric edges.

The stitch formation 26 is preferably of the Federal Stitch Type 406.

Referring now to FIG. 3, it will be seen that the looper thread 42 first extends transversely through a lower part of a loop 36 and then a lower part of a loop 40, and then forwardly and back through a lower part of a next adjacent loop 40. The looper thread 42 then extends rearwardly and around the first loop 40 and then forwardly and back through the lower part of a next forward loop 36. The looper thread 42 then extends behind and around the first loop 36 and forward and transversely through the forward loops 36 and 40. Thus each adjacent pair of loops 36 and each adjacent pair of loops 40 are joined together and each transversely adjacent set of loops 36, 40 are joined together.

It will be readily apparent that the needle threads 28 and 34 provide for the adequate seam strength while the needle thread 38 functions as an anchor for the transverse components of the looper thread 42 so that the looper thread holds the free edges 20, 22 of the fabric down.

It is to be understood that the stitch formations 24 and 26 will be simultaneously formed using, for example, a Class 35800 Union Special feed-off-the-arm machine, modified to produce the aforementioned stitch and seam type, and that the longitudinal spacing of all of the loops 30, 36, and 40 will be the same.

Returning once again to FIG. 1, it will be seen that when four fabric portions are being joined together, if end portions 44, 46 of a transverse seam are offset longitudinally of the seam 12, only a total of nine layers of fabric will be involved and at one point there will be only a total of seven layers of fabric.

Although only a preferred embodiment of the seam construction has been specifically illustrated and described herein, it is to be understood that minor variations may be made therein without departing from the spirit and scope of the invention, as defined by the appended claims.

We claim:

1. A longitudinal seam for a fabric and like tube, an outer edge of said tube being radially inwardly reversely folded to define a folded edge portion including a folded edge and a free edge, and an inner edge of said tube underlying said folded edge portion and having a free edge generally aligned with said fold edge portion free edge, a first needle thread disposed adjacent to and parallel to said folded edge and having loops extending through all three of the lapped layers, said first needle thread loops being joined together within said tube by a first looper thread, and second and third needle threads adjacent and on opposite sides of said free edges and parallel to said first needle thread and having loops joined by a second looper thread, said second needle thread loops extending through all three layers, said third needle thread extending through a single layer, and said second looper thread crisscrossing said free edges between said second and third needle thread loops.

2. A seam according to claim 1 wherein said first needle thread and said first looper thread form a stitch.

3. A seam according to claim 1 wherein said first needle thread and said first looper thread form a stitch of the one row Federal stitch type 401.

4. A seam according to claim 1 wherein said second and third needle threads and said second looper thread form a stitch.

5. A seam according to claim 1 wherein said second and third needle threads and said second looper thread form a stitch of the one row Federal stitch type 406.

6. A seam according to claim 2 wherein said second and third needle threads and said second looper thread form a second stitch.

7. A seam according to claim 6 wherein said two stitches are simultaneously formed.

8. A seam according to claim 6 wherein loops of all of said needle threads are like spaced in the direction of feed.

* * * * *